US008113168B2

(12) United States Patent
Yamada

(10) Patent No.: US 8,113,168 B2
(45) **Date of Patent: *Feb. 14, 2012**

(54) ENGINE UNIT AND VEHICLE INCLUDING THE SAME

(75) Inventor: Takayuki Yamada, Shizuoka (JP)

(73) Assignee: Yamaha Hatsudoki Kabushiki Kaisha, Iwata-Shi (JP)

( * ) Notice: Subject to any disclaimer, the term of this patent is extended or adjusted under 35 U.S.C. 154(b) by 592 days.

This patent is subject to a terminal disclaimer.

(21) Appl. No.: 12/248,697

(22) Filed: Oct. 9, 2008

(65) Prior Publication Data

US 2009/0095254 A1 Apr. 16, 2009

(30) Foreign Application Priority Data

Oct. 10, 2007 (JP) ..... 2007-264682

(51) Int. Cl.
*F02D 1/00* (2006.01)

(52) U.S. Cl. ..... 123/336; 123/337; 123/376

(58) Field of Classification Search ..... 123/336, 123/337, 376, 378, 399, 400, 403, 478
See application file for complete search history.

(56) References Cited

U.S. PATENT DOCUMENTS

| | | | | |
|---|---|---|---|---|
| 7,168,517 | B2 * | 1/2007 | Udono | 180/219 |
| 7,721,705 | B2 * | 5/2010 | Sato et al. | 123/336 |
| 2009/0095252 | A1 * | 4/2009 | Yamada | 123/336 |
| 2009/0101088 | A1 * | 4/2009 | Yamada | 123/54.4 |

FOREIGN PATENT DOCUMENTS

JP 2004-308536 A 11/2004

* cited by examiner

*Primary Examiner* — John Kwon
(74) *Attorney, Agent, or Firm* — Rabin & Berdo, PC

(57) ABSTRACT

An engine unit includes a V-type engine and a throttle body assembly. The throttle body assembly has front and rear throttle bodies, an actuator and a second rotational shaft. The front throttle bodies include front throttle valves that open and close front cylinders. The rear throttle bodies include rear throttle valves that open and close rear cylinders. The actuator is disposed, in a longitudinal direction, between center axes of the front cylinders and center axes of the rear cylinders. A shaft center of the second rotational shaft is located to the front of or to the rear of a shaft center of a first rotational shaft.

20 Claims, 12 Drawing Sheets

ENGINE UNIT AND VEHICLE INCLUDING THE SAME

CROSS REFERENCE TO RELATED APPLICATIONS

This application claims the benefit of priority under 35 USC 119 of Japanese patent application no. 2007-264682, filed on Oct. 10, 2007, which is incorporated by reference.

BACKGROUND OF THE INVENTION

1. Field of the Invention

The present invention relates to an engine unit for a vehicle that has a V-type engine and a throttle body assembly.

2. Description of Related Art

Various types of throttle body assemblies for V-type engines are known. For example, FIG. 12 illustrates a throttle body assembly 100 as disclosed in JP-A-2004-308536.

Throttle body assembly 100 includes a drum 102 attached to an input shaft 103. A wire 101 is wound around drum 102. Wire 101 is moved by operation of an acceleration grip (not shown) to rotate drum 102 and input shaft 103. An accelerator position sensor 116 is provided at one end of input shaft 103, which is also referred to as an accelerator position sensor (APS) shaft for this reason. The other end of input shaft 103 is connected to an output shaft 105 via a power transmission system 104. A gear 104*a* of power transmission system 104 is connected with a driving motor 120 via gears 121 and 122.

A base end of a first arm member 106 is fixed to a tip end of output shaft 105. One end of a first link 107 is attached to a tip end of first arm member 106 in a swingable manner. The other end of first link 107 is attached to a front arm portion 108*a* of a second arm member 108 in a swingable manner. Second arm member 108 rotates about a front valve shaft 109. A throttle valve 110 is attached to front valve shaft 109 in a front throttle portion 117. Front throttle portion 117 is opened and closed by throttle valve 110.

One end of a second link 111 is attached to a rear arm portion 108*b* of second arm member 108 in a swingable manner. The other end of second link 111 is attached to a tip end of a third arm member 112 in a swingable manner. A base end of third arm member 112 is fixed to a rear valve shaft 113. A throttle valve 114 is attached to rear valve shaft 113 in a rear throttle portion 118. Rear throttle portion 118 is opened and closed by throttle valve 114. A throttle position sensor 115 is attached to rear valve shaft 113 and detects a throttle opening angle.

When accelerator grip is operated, wire 101 moves and drum 102 and input shaft 103 rotate. The rotational amount of input shaft 103 is detected by accelerator position sensor 116 as an accelerator opening angle. Then, according to the detected accelerator opening angle, driving motor 120 is driven. The rotation of driving motor 120 is transmitted to front valve shaft 109 and rear valve shaft 113 via gears 121 and 122, power transmission system 104, output shaft 105, first arm member 106, first link 107, second arm member 108, second link 111, and third arm member 112. As a consequence, front valve shaft 109 and rear valve shaft 113 rotate, thereby opening and closing throttle valves 110 and 114.

As described in paragraph 50 of JP-A-2004-308536, input (APS) shaft 103 and output shaft 105 overlap with driving motor 120 in a vertical direction. Therefore, throttle body assembly 100 can be made compact and protrusion of throttle body assembly 100 from throttle portions 117 and 118 can be reduced.

As shown in FIG. 12, driving motor 120 is disposed between front throttle portion 117 and rear throttle portion 118. Therefore, compared with a case in which driving motor 120 is disposed in front of front throttle portion 117 or at the rear of rear throttle portion 118, a longitudinal length of throttle body assembly 100 is shortened. Nevertheless, since input (APS) shaft 103 and driving motor 120 are arranged one above the other in a vertical direction, it is difficult to make the height dimension of throttle body assembly 100 small enough. Accordingly, the use of throttle body assembly 100 makes it difficult to sufficiently reduce the size of the V-type engine.

SUMMARY OF THE INVENTION

The invention addresses this problem and achieves size reduction of an engine unit that includes a throttle body assembly.

An engine unit of the invention includes a throttle body assembly attached to a V-type engine. The V-type engine has a front cylinder connected to a front intake port and a rear cylinder connected to a rear intake port connected to the rear cylinder.

The throttle body assembly includes front and rear throttle bodies, an actuator and a second rotational shaft. A front cylinder of the front throttle body is connected to the front intake port. A front throttle valve opens and closes the front cylinder. A rear cylinder of the rear throttle body is connected to the rear intake port. A rear throttle valve opens and closes the rear cylinder. The actuator drives the front and rear throttle valves and has a first rotational shaft that extends in a widthwise direction. The actuator is disposed between center axes of the front and rear cylinders in a longitudinal direction. The shaft center of the second rotational shaft is located in front of or at the rear of the shaft center of the first rotational shaft.

A vehicle according to the invention includes the engine unit described above.

In the invention, the first and second rotational shafts are offset other in a longitudinal direction. Therefore, the throttle body assembly as well as the engine unit can be made compact.

Other features and advantages of the invention will be apparent from the following detailed description, taken in conjunction with the accompanying drawings that illustrate, by way of example, various features of embodiments of the invention.

DETAILED DESCRIPTION OF THE INVENTION

Figure 1:
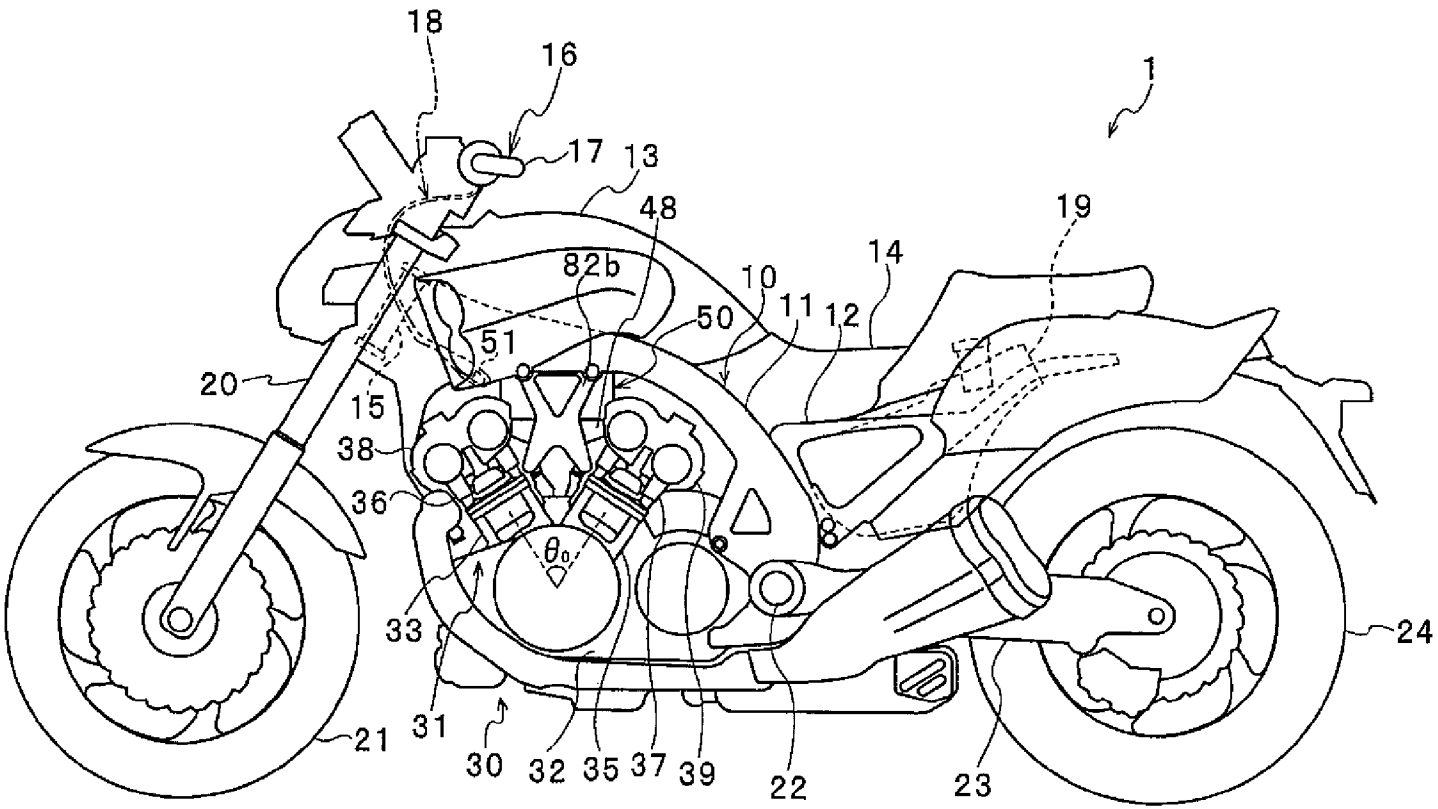
FIG. 1 is a left side view of a motorcycle according to the invention.

An embodiment of the invention is now described with reference to a motorcycle 1 (FIG. 1). However, the invention is not restricted to a motorcycle and may be any vehicle including a V-type engine, including four-wheeled and straddle-type vehicles. A straddle-type vehicle is a vehicle on which a rider straddles a seat (saddle) and may include an all terrain vehicle (ATV) and the like in addition to a motorcycle. Furthermore, the motorcycle is not restricted to a so-called American-type motorcycle and may be other types of motorcycles, a moped, a scooter, an off-road vehicle and the like. Moreover, a motorcycle includes a vehicle with multiple wheels that rotate together with at least one of the front and rear wheels, and that is tilted to change a traveling direction.

In the following description, the longitudinal and horizontal directions are from the perspective of a rider seated on a seat 14.

(Overall Structure of Motorcycle 1)

As shown in FIG. 1, motorcycle 1 has a vehicle body frame 10, a vehicle body cover 13 and a seat 14. A part of vehicle body frame 10 is covered by vehicle body cover 13. Seat 14 is disposed on the top of vehicle body frame 10.

Vehicle body frame 10 has a main frame 11 and a rear frame 12. Main frame 11 includes left and right frame portions 11*a* and 11*b* that extend to the rear from a head pipe 15. Head pipe 15 is rotatably attached to main frame 11. A handle 16 is fixed to an upper end portion of head pipe 15 by a handle holder (not shown) and is provided with a throttle grip 17 as a throttle operator. Throttle grip 17 is connected to an accelerator position sensor (APS) 51 by a throttle wire 18. Therefore, when throttle grip 17 is operated by a rider, throttle wire 18 is moved and the amount of operation of throttle grip 17 is detected by accelerator position sensor 51 as an accelerator opening angle.

A front fork 20 with forks to the left and right is fixed to head pipe 15 and extends obliquely downward to the front. A front wheel 21 is rotatably attached to a lower end portion of front fork 20. A pivot shaft 22 is attached to a rear end portion of vehicle body frame 10. A rear arm 23 is attached to pivot shaft 22 in a swingable manner. A rear wheel 24 is rotatably attached to a rear end portion of rear arm 23. Rear wheel 24 is connected with an output shaft of an engine unit 30 by a power transmission mechanism such as a drive shaft. Power from engine unit 30 is thereby transmitted to rear wheel 24 and rotates rear wheel 24.

Figure 2:
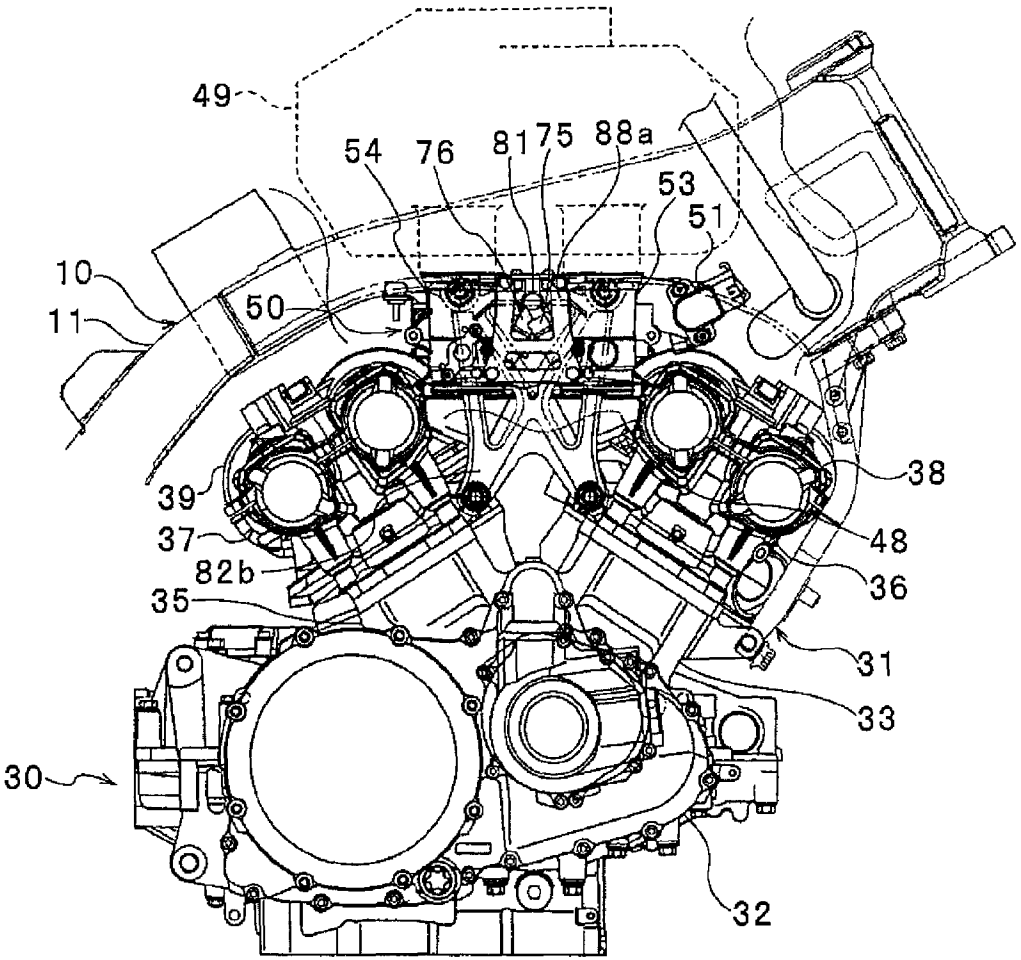
FIG. 2 is an enlarged right side view of an engine unit of the motorcycle.
Figure 4:
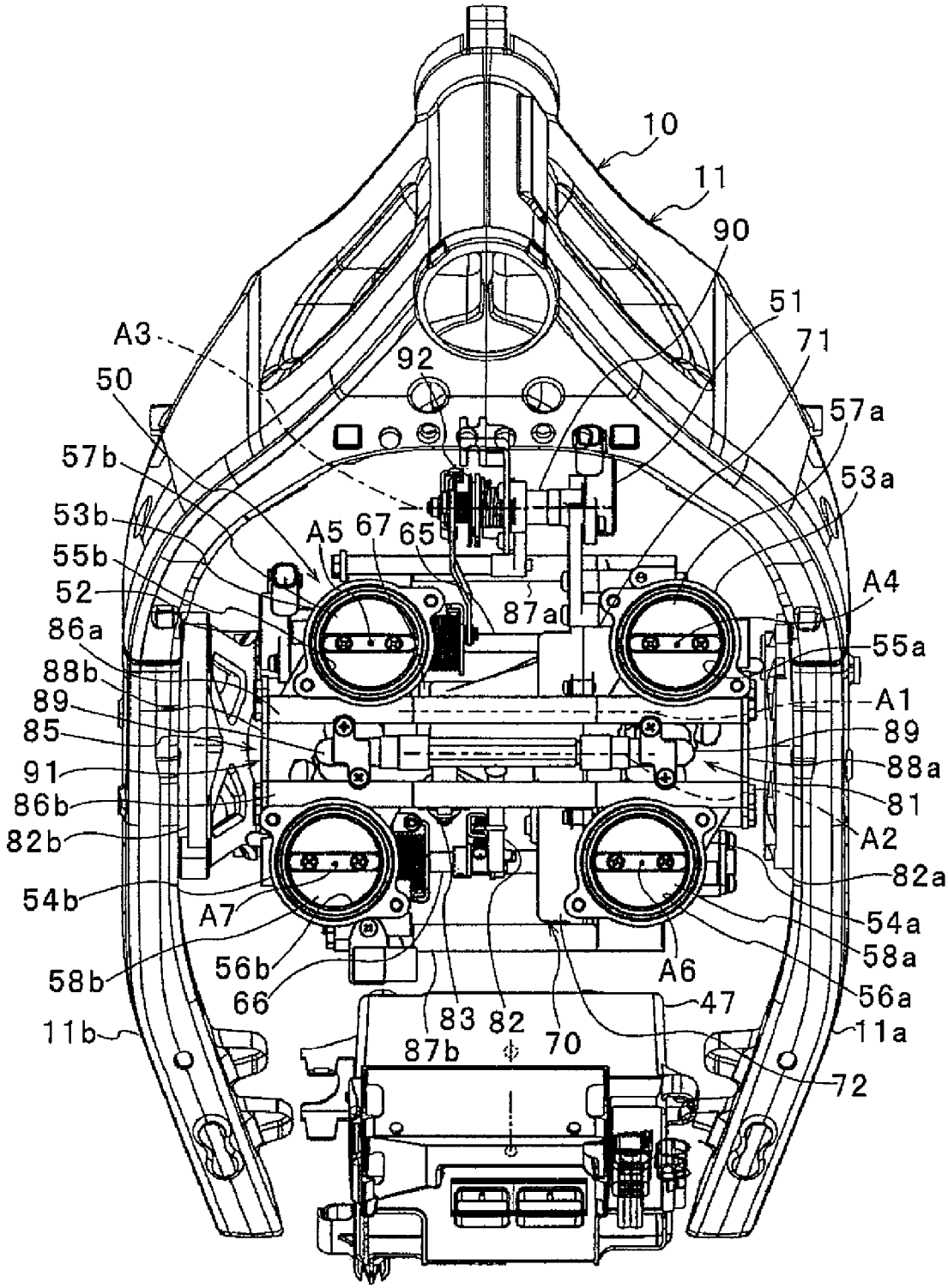
FIG. 4 is a plan view of the throttle body assembly.

As shown in FIGS. 1 and 2, engine unit 30 is suspended from main frame 11. Engine unit 30 includes a V-type engine 31, a throttle body assembly 50, a clutch, a transmission mechanism and the like. Throttle body assembly 50 is disposed on engine 31 between left and right frame portions 11*a* and 11*b* in a plan view (FIG. 4).

Figure 3:
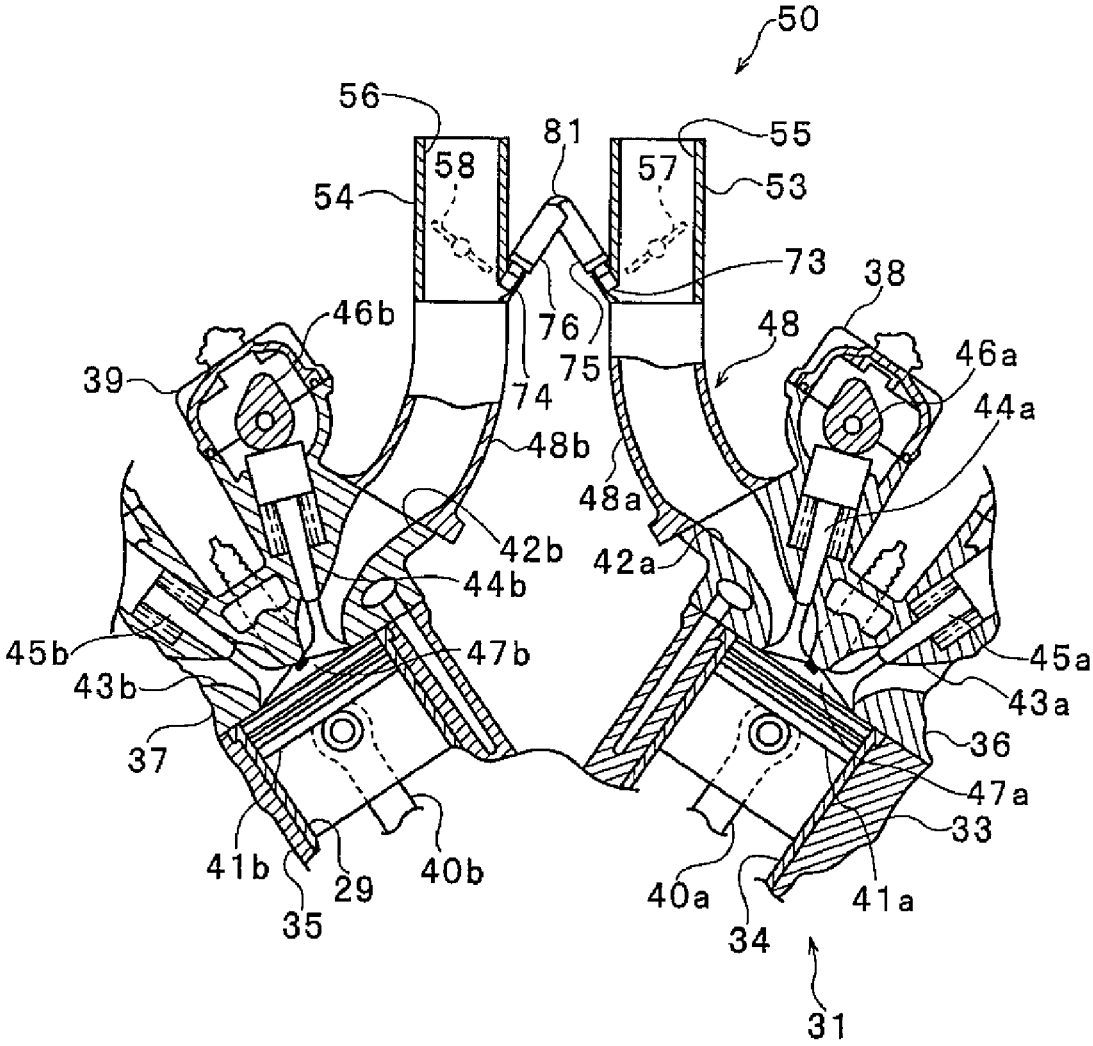
FIG. 3 is a cross-sectional view of a throttle body assembly and an engine of the engine unit.

An insulator 48 is disposed between engine unit 30 and throttle body assembly 50. Insulator 48, engine 31, and throttle body assembly 50 are mutually fixed by cross members 82*a* and 82*b* arranged at both sides of the vehicle in a widthwise direction. As shown in FIG. 3, insulator 48 is provided with connecting channels 48*a* and 48*b* that connect intake ports 42*a* and 42*b* of engine 31 to respective cylinders 55 and 56 of throttle body assembly 50.

As shown in FIG. 2, an air cleaner 49 that serves as an intake system part is arranged on and supplies outside air to throttle body assembly 50. As an alternative to air cleaner 49, an air chamber may be arranged as the intake system part.

As shown in FIG. 1, a fuel tank 19 is disposed at the rear of engine 31. Fuel tank 19 is connected with a fuel nipple 82 of throttle body assembly 50 (FIG. 4) by a fuel supply hose. Fuel stored in fuel tank 19 is supplied to throttle body assembly 50 through the fuel supply hose. Air and fuel supplied to throttle body assembly 50 are mixed in throttle body assembly 50, thereby creating an air-fuel mixture that is supplied to engine 31.

As shown in FIG. 4, in a space enclosed by main frame 11 in a plan view, a battery 47 that supplies power to engine unit 30 and to throttle body assembly 50 is installed at the immediate rear of throttle body assembly 50.

(Engine 31)

Engine 31 is now described, mainly with reference to FIGS. 1-3. In this embodiment, engine 31 is a water-cooled 4-stroke V-type 4-cylinder engine. However, engine 31 is not particularly restricted as long as it is a V-type engine and may be, for example, an air-cooled engine or a 2-stroke engine. Furthermore, engine 31 may be a V-type engine with three cylinders or less or five cylinders or more.

"V-type engine" as used herein refers to an engine having a front cylinder and a rear cylinder that are arranged in such a manner as to form a V-bank. That is, the front and rear cylinders are arranged such that a center axes of the front and rear cylinders diagonally intersect with each other with a shaft center of a crankshaft being the center of the intersection.

As shown in FIG. 2, engine 31 has a crankcase 32 that houses a crankshaft. Crankcase 32 is attached with a front cylinder body 33 and a rear cylinder body 35. Front cylinder body 33 and rear cylinder body 35 are arranged in a V-shape having the crankshaft as a center thereof in a side view. A front cylinder head 36 is provided on front cylinder body 33, and a front head cover 38 is provided on the top of front cylinder head 36. Similarly, a rear cylinder head 37 is provided on the top of rear cylinder body 35, and a rear head cover 39 is provided on top of rear cylinder head 37.

As shown in FIG. 3, a front cylinder 34 formed in a substantially cylindrical shape is provided in front cylinder body 33, and a rear cylinder 29 formed in a substantially cylindrical shape is provided in rear cylinder body 35. Front cylinder 34 and rear cylinder 29 are arranged to form a V-bank. Specifically, front cylinder 34 is disposed to extend obliquely upward to the front, while rear cylinder 29 is disposed to extend obliquely upward to the rear. The degree of an angle $\theta_0$ formed by center axes of front and rear cylinders 34 and 29 (FIG. 1) is set such that cylinders 34 and 29 do not positionally interfere with each other in consideration of engine noise caused by engine 31, characteristics to be obtained by engine 31, and the like. The angle $\theta_0$ is normally in the range of 10-170 degrees, preferably in the range of 30-150 degrees, and more preferably in the range of 45-100 degrees.

As shown in FIG. 3, front cylinder 34 and rear cylinder 29 respectively house connecting rods 40*a* and 40*b* that are connected to respective crankshafts. Pistons 41*a* and 41*b* are attached to the tip end portions of connecting rods 40*a* and 40*b*. Pistons 41*a* and 41*b*, cylinders 34 and 29, and cylinder heads 36 and 37 define and form combustion chambers 47*a* and 47*b*.

Front cylinder head 36 and rear cylinder head 37 are provided with intake ports 42*a* and 42*b* and exhaust ports 43*a* and 43*b*, respectively. Intake ports 42*a* and 42*b* are provided with intake valves 44*a* and 44*b* that open and close intake ports 42*a* and 42*b*. Intake valves 44*a* and 44*b* are driven by intake cams 46*a* and 46*b* disposed on the top face of intake valves 44*a* and 44*b*. Similarly, exhaust ports 43*a* and 43*b* are provided with exhaust valves 45*a* and 45*b* that open and close exhaust ports 43 and are driven by exhaust cams.

(Throttle Body Assembly 50)

—Front Throttle Body 53 and Rear Throttle Body 54—

Throttle body assembly 50 is now described in detail with reference mainly to FIGS. 4-9. Throttle body assembly 50 includes a first front throttle body 53*a* and a second front throttle body 53*b*. In the following descriptions, front throttle bodies 53*a* and 53*b* may be collectively called front throttle bodies 53.

Front throttle bodies 53*a* and 53*b* are arranged in the vehicle width direction. First front throttle body 53*a* is provided with a first front cylinder 55*a* formed in a substantially cylindrical shape, and second throttle body 53*b* is provided with a second front cylinder 55*b* formed in a substantially cylindrical shape. Front cylinders 55*a* and 55*b* extend in a vertical direction, respectively. In the following description, front cylinders 55*a* and 55*b* may be collectively called front cylinders 55.

Front throttle bodies 53*a* and 53*b* have front throttle valves 57*a* and 57*b*, respectively. In the following description, front throttle valves 57*a* and 57*b* may be collectively called front throttle valves 57. Front throttle valve 57*a* is connected with front throttle valve 57*b* by a valve shaft 65. When valve shaft 65 is rotated by a motor 60, front throttle valves 57*a* and 57*b* move simultaneously to open and close front cylinders 55*a* and 55*b*.

A first rear throttle body 54*a* and a second rear throttle body 54*b* are arranged at the rear of front throttle bodies 53*a* and 53*b*. In the following description, rear throttle bodies 54*a* and 54*b* may be collectively called rear throttle bodies 54. Rear throttle bodies 54*a* and 54*b* are arranged in the vehicle width direction. First rear throttle body 54*a* is disposed approximately to the rear of first front throttle body 53*a* and second rear throttle body 54*b* is disposed approximately to the rear of second front throttle body 53*b*. However, due to the arrangement of connecting rods 40*a* and 40*b*, front throttle bodies 53*a* and 53*b* are arranged slightly offset with respect to rear throttle bodies 54*a* and 54*b* in the vehicle width direction.

In the embodiment, upper ends of front throttle bodies 53*a* and 53*b* and upper ends of rear throttle bodies 54*a* and 54*b* are located at the same height.

First rear throttle body 54*a* is provided with a first rear cylinder 56*a* formed in a substantially cylindrical shape. Meanwhile, second rear throttle body 54*b* is provided with a second rear cylinder 56*b* formed in a substantially cylindrical shape. In the following description, rear cylinders 56*a* and 56*b* may be collectively called rear cylinders 56.

Rear throttle bodies 54*a* and 54*b* have rear throttle valves 58*a* and 58*b*, respectively. Hereafter, rear throttle valves 58*a* and 58*b* may be collectively called rear throttle valves 58. Rear throttle valve 58*a* is connected with rear throttle valve 58*b* by a valve shaft 66. When valve shaft 66 is rotated by motor 60, rear throttle valves 58*a* and 58*b* move simultaneously to opens and closes rear cylinders 56*a* and 56*b*.

As shown in FIG. 2, the upper end portions of front cylinders 55 and rear cylinders 56 are connected to air cleaner 49. The lower ends of front cylinders 55 rear cylinders 56 are connected to intake ports 42*a* and 42*b*, as shown in FIG. 3. By this structure, air taken from air cleaner 49 is supplied to engine 31 via throttle body assembly 50.

—Injectors 75 and 76 and Fuel Supply Pipe 81—

Figure 8:
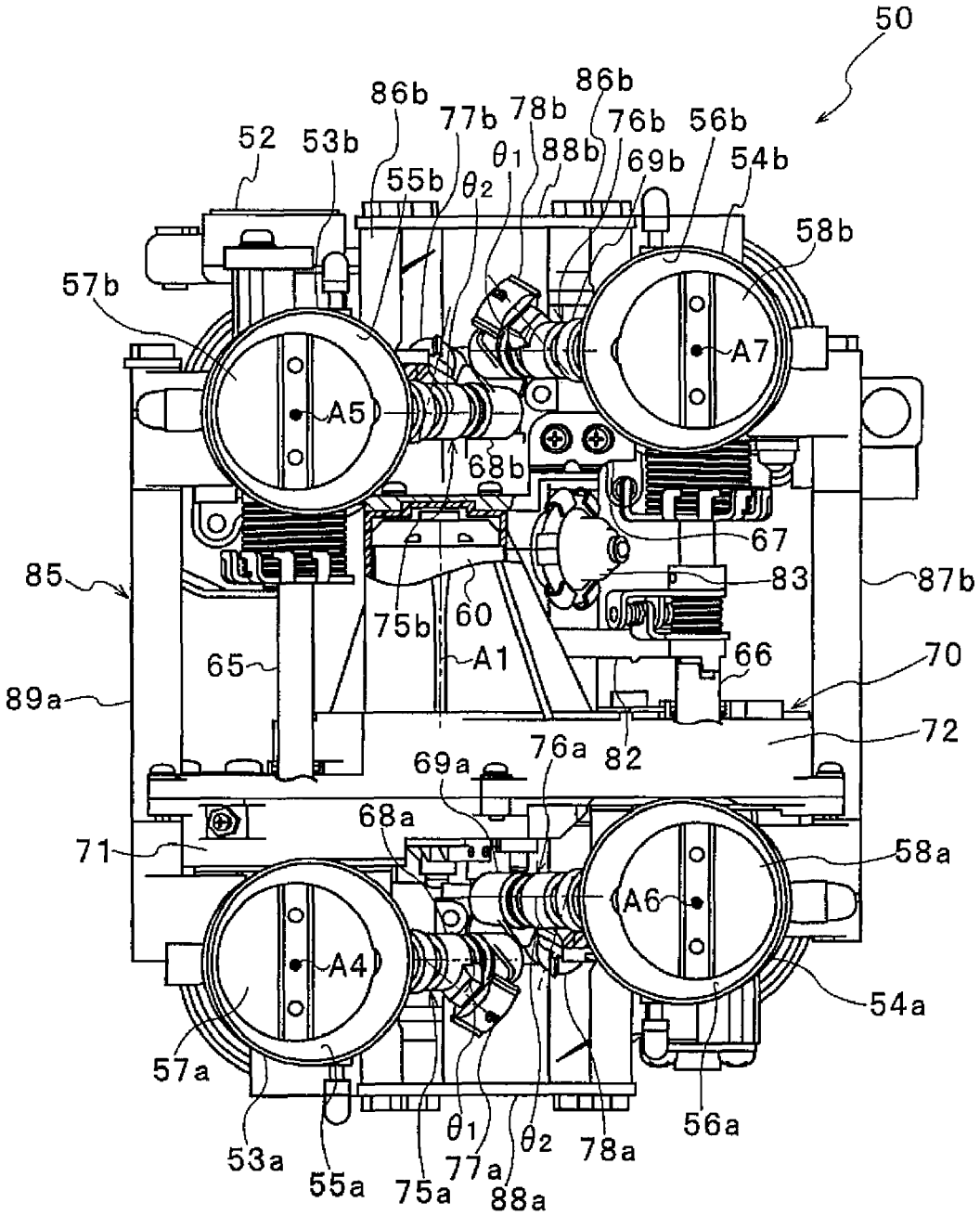
FIG. 8 is a rear view of the throttle body assembly.

As mainly shown in FIG. 8, front throttle bodies 53*a* and 53*b* are provided with front injectors 75*a* and 75*b*, respectively, and rear throttle bodies 54*a* and 54*b* are provided with rear injectors 76*a* and 76*b*, respectively. In the following description, front injectors 75*a* and 75*b* may be collectively called front injectors 75. and rear injectors 76*a* and 76*b* may be collectively called rear injectors 76.

As shown in FIGS. 2 and 3, upper end portions of front injectors 75 and rear injectors 76 are connected to a fuel supply pipe 81. As shown in FIG. 4, fuel supply pipe 81 extends between front and rear cylinders 55 and 56 in the vehicle width direction. More specifically, a center axis A2 of fuel supply pipe 81 is located at the center of center axes A4 and A5 of front cylinders 55 and center axes A6 and A7 of rear cylinders 56 in the longitudinal direction. Furthermore, in relation to the vertical direction, fuel supply pipe 81 is disposed at a position that is lower than the upper ends of front and rear throttle bodies 53 and 54 and higher than the lower ends of throttle bodies 53 and 54. Note that, when the upper ends of front throttle bodies 53 and the upper ends of rear throttle bodies 54 are different in height, which is not the case in this embodiment, fuel supply pipe 81 is preferably disposed at a position lower than the upper ends of front throttle bodies 53 or the upper ends of rear throttle bodies 54, whichever is higher.

As shown in FIG. 4, fuel supply pipe 81 is connected with a fuel nipple 82 that extends to the rear from fuel supply pipe 81 between rear cylinders 56*a* and 56*b*. Fuel nipple 82 is connected to fuel tank 19 (FIG. 1) by a fuel supply pipe (not shown). The fuel in fuel tank 19 is thereby supplied to front and rear injectors 75 and 76 via the fuel pipe, fuel nipple 82 and fuel supply pipe 81.

As shown in FIGS. 4 and 8, a pulsation damper 83 is attached to fuel supply pipe 81. Pulsation damper 83 is located at the rear of and slightly obliquely downward from fuel supply pipe 81. Pulsation damper 83 suppresses pulsation of fuel supplied to front and rear injectors 75 and 76.

A nozzle 73 provided at the tip ends of front injectors 75, as shown in FIG. 3, is adjusted such that fuel injected from front injectors 75 is injected centering on the center axis direction of front cylinders 55. Similarly, a nozzle 74 provided at the tip ends of rear injectors 76 is adjusted such that fuel is injected centering on the center axis direction of rear cylinders 56.

Figure 6:
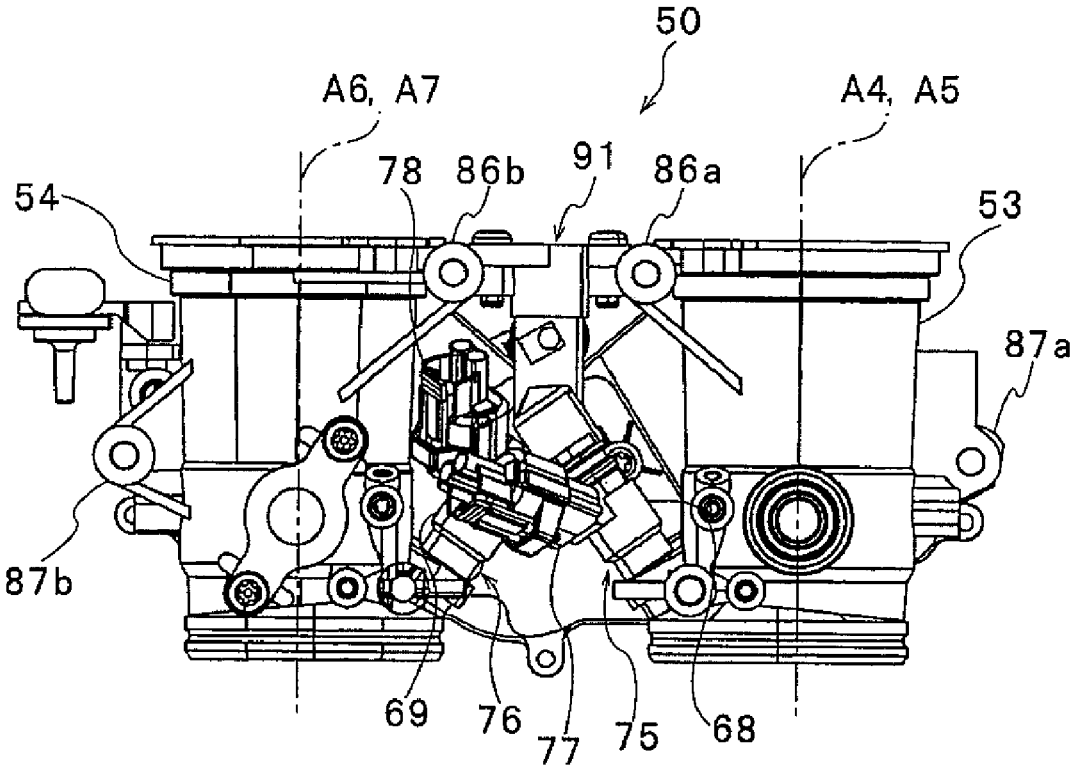
FIG. 6 is a right side view of the throttle body assembly.
Figure 7:
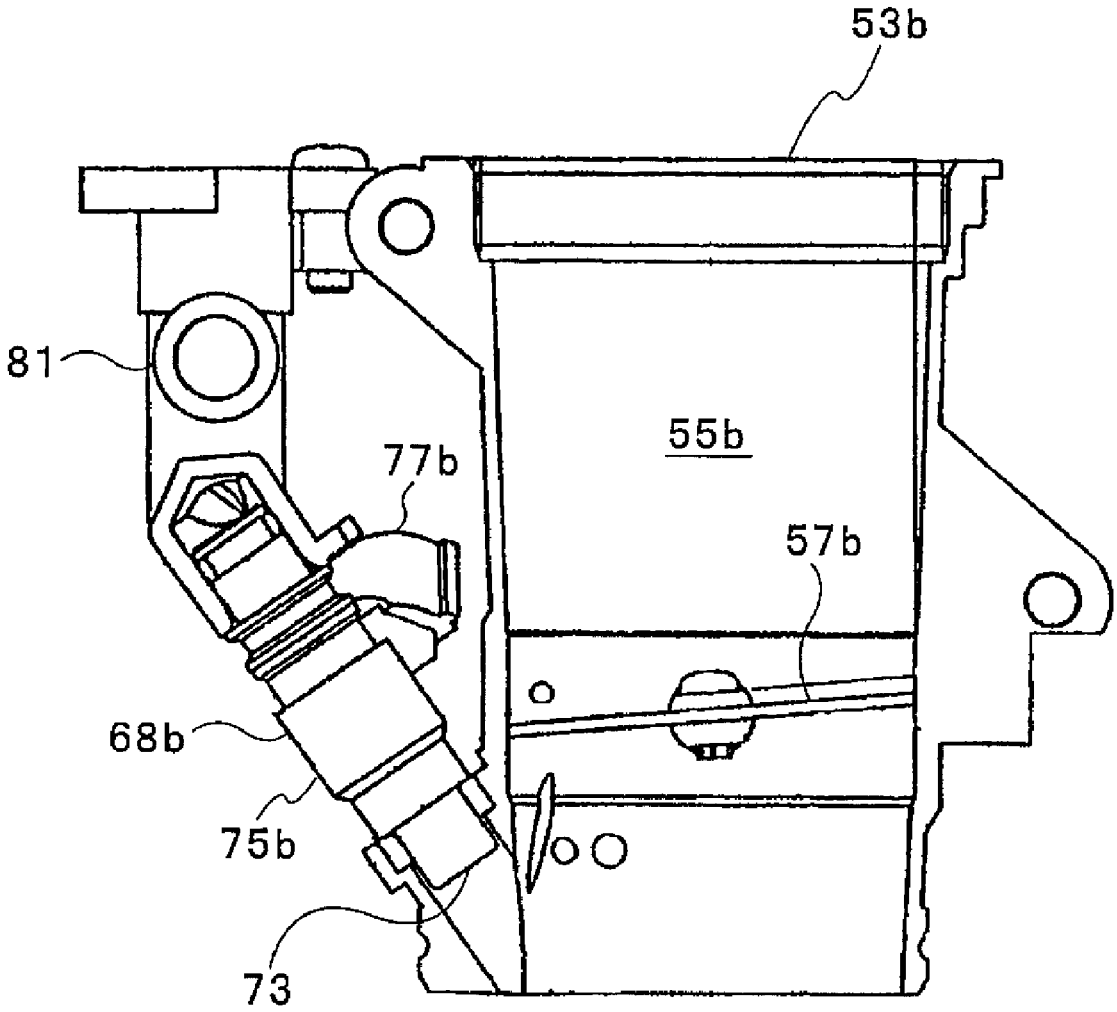
FIG. 7 is a cross-sectional view of a second front throttle body.

As shown in FIGS. 6 and 8, front injectors 75*a* and 75*b* include injector main bodies 68*a* and 68*b* and first front connectors 77*a* and 77*b*. Rear injectors 76*a* and 76*b* include injector main bodies 69*a* and 69*b* and first rear connectors 78*a* and 78*b*. Hereafter, injector main bodies 68*a* and 68*b* may be collectively called injector main bodies 68, first front connectors 77*a* and 77*b* may be collectively called front connectors 77, injector main bodies 69*a* and 69*b* may be collectively called injector main bodies 69, and first rear connectors 78*a* and 78*b* may be collectively called rear connectors 78.

Figure 10:
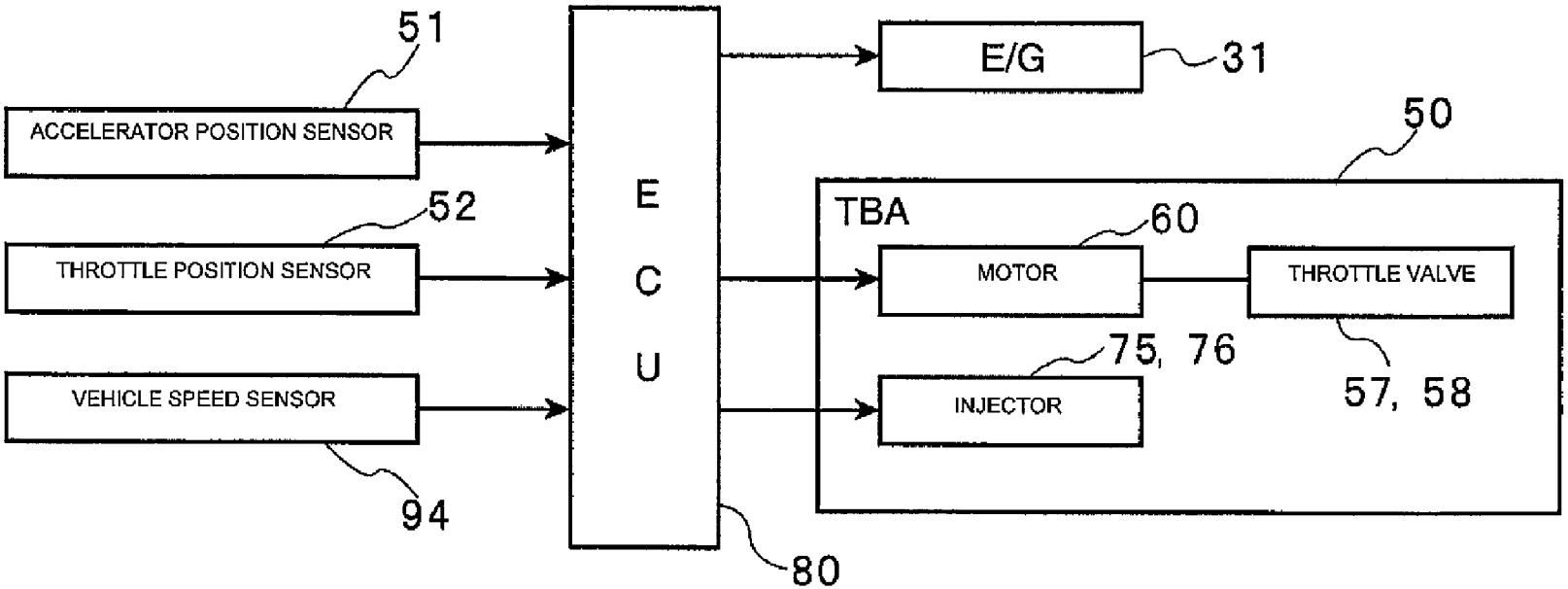
FIG. 10 is a block diagram of a control block of the motorcycle.

Connectors 77 and 78 are connected to an electronic control unit (ECU) 80 shown in FIG. 10. A control signal is sent from ECU 80 to injectors 75 and 76 via connectors 77 and 78, thereby controlling fuel injection from injectors 75 and 76. Note that, although FIG. 6 is a right side view of throttle body assembly 50, a right fixing plate 88*a* shown in FIG. 4 is omitted from FIG. 6 for convenience in illustrating connectors 77 and 78.

As shown in FIG. 8, injector main bodies 68 and 69 extend in the longitudinal direction in a plan view. On the other hand, connectors 77 and 78 extend obliquely in relation to the longitudinal direction in the plan view. To be specific, front connectors 77*a* and 77*b* extend obliquely to the rear in mutually opposite directions in the vehicle width direction. More specifically, front connectors 77*a* and 77*b* extend obliquely to the rear and outward in the vehicle width direction. Rear connectors 78*a* and 78*b* extend obliquely to the rear in mutually opposite directions in the vehicle width direction. To be specific, rear connectors 78*a* and 78*b* extend obliquely to the rear and outward in the vehicle width direction.

An angle formed by the center axis of injector main body 68*a* located on the outer side of the vehicle in the vehicle width direction and an extending direction of first front connector 77*a* in the plan view, and an angle formed by the centerline of injector main body 69*b* and an extending direction of second rear connector 78*b* in the plan view are both equally set to be $\theta_1$. Meanwhile, an angle formed by the center axis of injector main body 68*b* located on the inner side of the vehicle in the vehicle width direction and an extending direction of second front connector 77*b* in the plan view, and an angle formed by the center axis of injector main body 69*a* and an extending direction of first rear connector 78*a* in the plan view are both equally set to be $\theta_2$. $\theta_i$ and $\theta_2$ are set within a range that does not cause positional interference between connectors 77 and 78. A preferable range of $\theta_1$ and $\theta_2$ is between 5 and 180 degrees.

—Motor 60—

Figure 9:
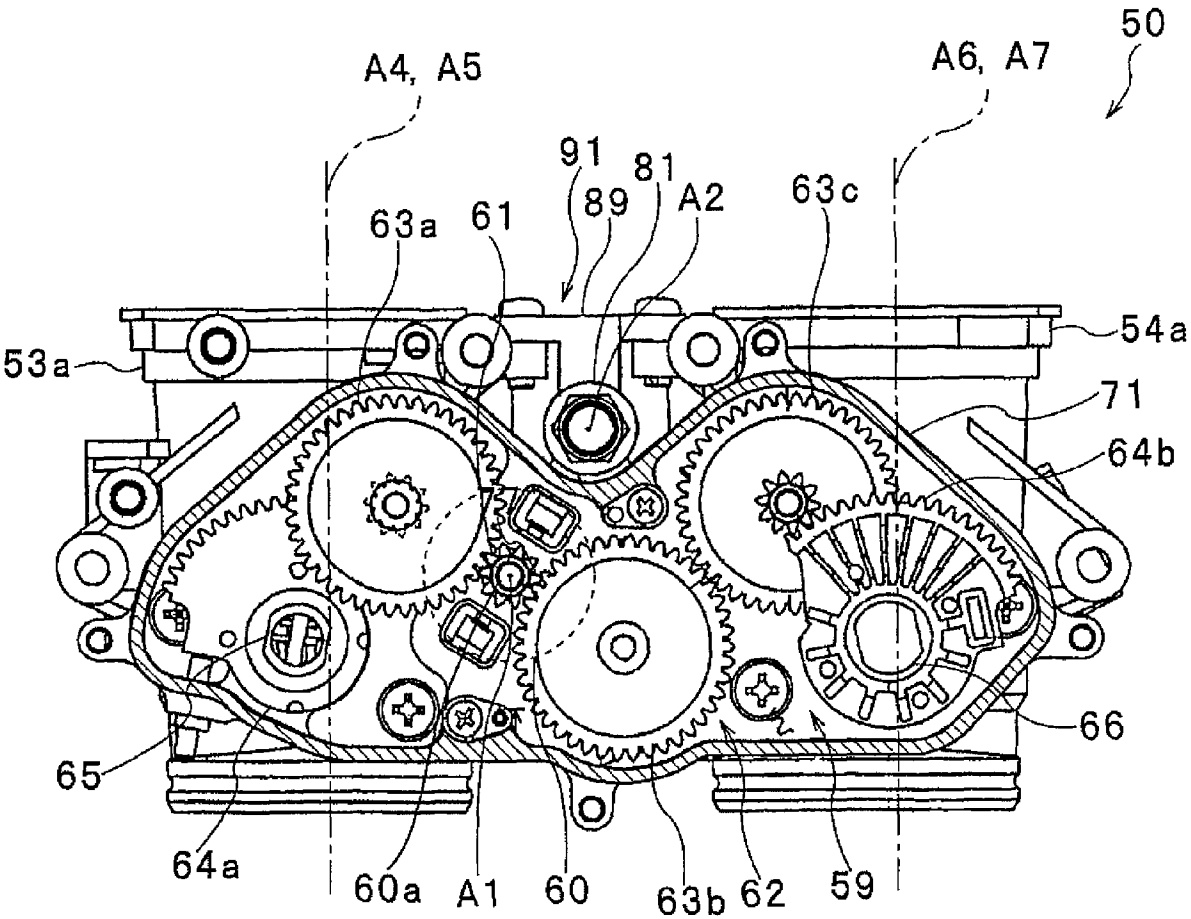
FIG. 9 is a cross-sectional view of the throttle body assembly illustrating a deceleration gear mechanism.

Throttle body assembly 50 has a motor 60. As shown in FIG. 9, motor 60 has a rotational shaft 60*a* as a first rotational shaft. A shaft center A1 of rotational shaft 60*a* extends in the vehicle width direction. Rotational shaft 60*a* is provided with a motor pinion gear 61. Motor pinion gear 61 is engaged with a transmission gear mechanism 62 that includes three idle gears 63*a*, 63*b* and 63*c* and two counter gears 64*a* and 64*b*. Counter gear 64*a* is fixed to valve shaft 65 and counter gear 64*b* is fixed to valve shaft 66. Motor pinion gear 61 is engaged with counter gear 64*a* via one idle gear 63*a*. On the other hand, since motor pinion gear 61 and counter gear 64*b* are located relatively apart from each other, motor pinion gear 61 is engaged with counter gear 64*b* via two idle gears 63*b* and 63*c*. By this structure, when motor 60 is driven and motor pinion gear 61 rotates, counter gears 64*a* and 64*b* are rotated and valve shafts 65 and 66 are rotated in the same direction. As a result, front throttle valves 57*a* and 57*b* and rear throttle valves 58*a* and 58*b* (FIG. 4) are rotated, and thus cylinders 55 and 56 are opened and closed in synchronization. In this embodiment, motor 60 and transmission gear mechanism 62 are collectively called a throttle valve drive mechanism 59.

As shown in FIG. 8, in the plan view, motor 60 as an actuator is disposed in an area enclosed by the center axis A4 of first front cylinder 55*a*, center axis A5 of second front cylinder 55*b*, center axis A6 of first rear cylinder 56*a*, and center axis A7 of second rear cylinder 56*b*. As FIG. 9 illustrates, in relation to the vertical direction, motor 60 is disposed at a position that is lower than the upper ends and higher than the lower ends of throttle bodies 53 and 54. That is, motor 60 is disposed in a space enclosed by the four throttle bodies, namely, front throttle bodies 53*a* and 53*b* and rear throttle bodies 54*a* and 54*b*.

As shown in FIG. 9 and FIG. 4, motor 60 is offset with respect to fuel supply pipe 81 in the longitudinal direction. Specifically, shaft center A1 of rotational shaft 60*a* as first rotational shaft of motor 60 and center axis A2 of fuel supply pipe 81 are located at different positions in the longitudinal direction. More specifically, shaft center A1 is located in front of center axis A2 of fuel supply pipe 81. That is, as FIG. 9 illustrates, motor 60 is disposed such that shaft center A1 is located, in the longitudinal direction, between center axis A2 of fuel supply pipe 81 and center axes A4 and A5 of front cylinders 55.

—Casing 70—

As shown in FIGS. 4 and 8, motor 60 and transmission gear mechanism 62 are housed in a casing 70. As FIG. 8 illustrates, valve shafts 65 and 66 connected to transmission gear mechanism 62 pass through casing 70.

Casing 70 has a first casing portion 71 and a second casing portion 72 that face each other in the vehicle width direction. Casing portions 71 and 72 are fixed to each other by a bolt, rivet or the like. First casing portion 71 is disposed closer to transmission gear mechanism 62 and is made of a metal such as iron or an alloy such as aluminum and stainless steel. In this embodiment, first casing portion 71 is made of die cast aluminum.

First casing portion 71 is fixed to first front throttle body 53*a* and first rear throttle body 54*a*. Specifically, a portion of casing 70 that houses transmission gear mechanism 62 and is penetrated by valve shafts 65 and 66 is directly fixed to throttle bodies 53*a* and 54*a*.

Second casing portion 72 is located closer to motor 60 and is made of a resin such as polybutylene terephthalate (PBT) or the like. The resin that forms second casing portion 72 may include, for example, a glass fiber. In addition, second casing portion 72 may be made of a metal like first casing portion 71.

Second casing portion 72 is fixed to second rear throttle body 54*b* via a metal stay 67 (FIG. 8). To be more specific, stay 67 is fastened by a bolt to a top part of a portion of second casing portion 72 that houses motor 60. Stay 67 is also fastened by a bolt to second rear throttle body 54*b*.

—Connecting Member 85—

As shown in FIG. 4, front throttle bodies 53*a* and 53*b* and rear throttle bodies 54*a* and 54*b* are fixed to each other by a connecting member 85. Connecting member 85 includes two inner connecting pipes 86*a* and 86*b*, two outer connecting pipes 87*a* and 87*b*, right fixing plate 88*a*, and a left fixing plate 88*b*.

Inner connecting pipes 86*a* and 86*b* and outer connecting pipes 87*a* and 87*b* extend in the vehicle width direction. As is illustrated by FIG. 6, inner connecting pipes 86*a* and 86*b* are disposed in different positions to outer connecting pipes 87*a* and 87*b* in the vertical direction. Specifically, inner connecting pipes 86*a* and 86*b* are disposed approximately at the same position in the vertical direction as the upper end portions of throttle bodies 53 and 54. On the other hand, outer connecting pipes 87*a* and 87*b* are disposed approximately at the same position in the vertical direction as the center portions of throttle bodies 53 and 54.

As shown in FIGS. 4 and 6, inner connecting pipes 86*a* and 86*b* are disposed between center axes A4 and A5 of front cylinders 55 and center axes A6 and A7 of rear cylinders 56. Inner connecting pipe 86*a* is fixed to front throttle bodies 53*a* and 53*b* to the rear of center axes A4 and A5 of front cylinders 55. Inner connecting pipe 86*b* is fixed to rear throttle bodies 54*a* and 54*b* to the front of center axes A6 and A7 of rear cylinders 56. Inner connecting pipes 86*a* and 86*b* are mutually fixed at two points in the widthwise direction by two fixing members 89; In the following description, inner connecting pipes 86*a* and 86*b* and fixing members 89 may be collectively called inner connecting member 91.

Outer connecting pipe 87*a* is fixed to front throttle bodies 53*a* and 53*b* to the front of center axes A4 and A5 of front cylinders 55. On the other hand, outer connecting pipe 87*b* is fixed to rear throttle bodies 54*a* and 54*b* to the rear of center axes A6 and A7 of rear cylinders 56.

As described above, front throttle bodies 53*a* and 53*b* are securely fixed to each other by being sandwiched by inner connecting pipe 86*a* and outer connecting pipe 87*a*. Furthermore, rear throttle bodies 54*a* and 54*b* are securely fixed to each other by being sandwiched by inner connecting pipe 86*b* and outer connecting pipe 87*b*.

Figure 5:
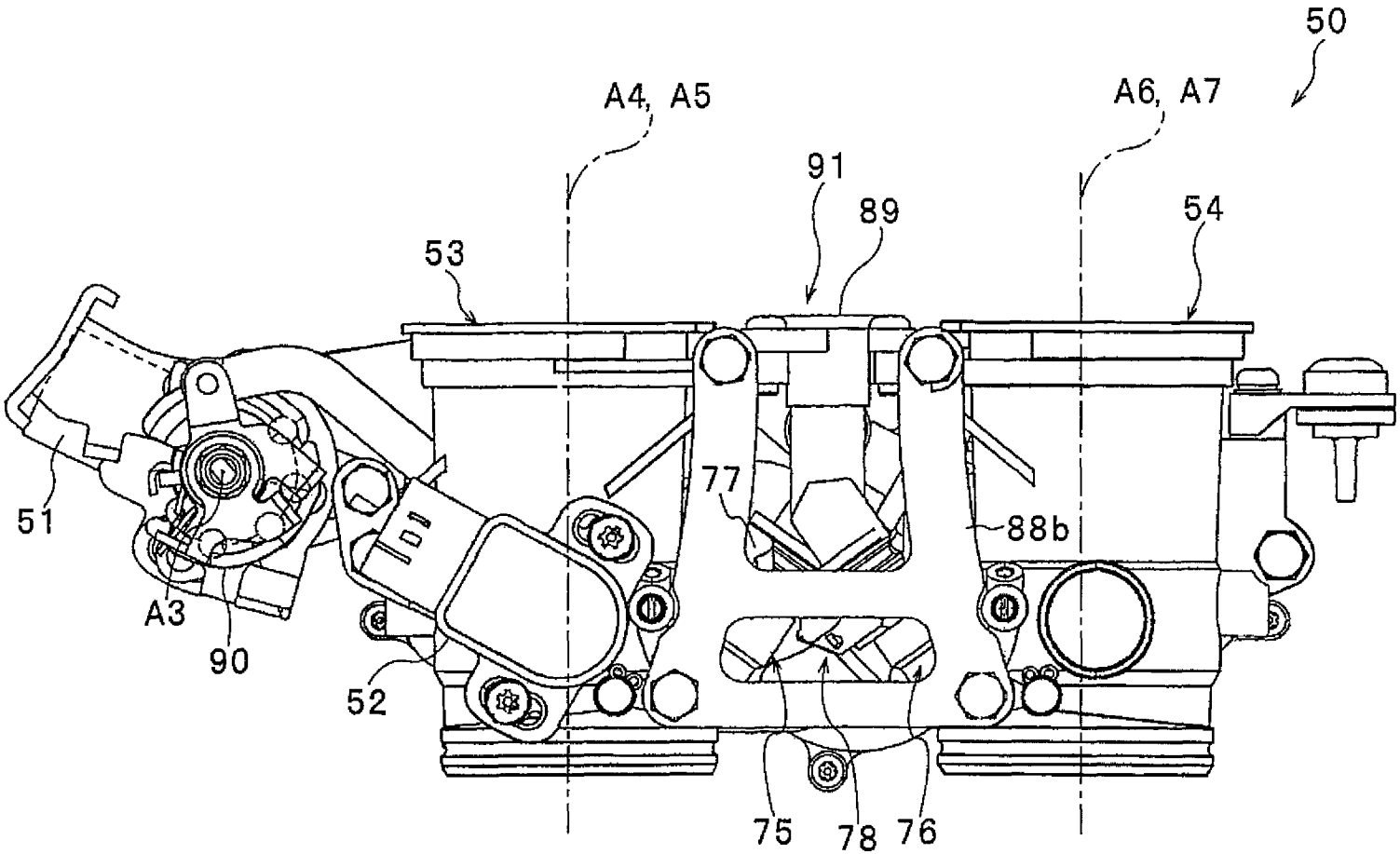
FIG. 5 is a left side view of the throttle body assembly.

In addition, as shown in FIGS. 4 and 5, front throttle bodies 53*a* and 53*b* and rear throttle bodies 54*a* and 54*b* are fixed to each other by right fixing plate 88*a* that serves as a right fixing member and left fixing plate 88*b* that serves as a left fixing member. More specifically, as shown in FIG. 5, left fixing plate 88*b* is fixed by four points, namely, the upper and lower portions of second front throttle body 53*b* and the upper and lower portions of second rear throttle body 54*b*. Right fixing plate 88*a* is fixed by four points, namely, the upper and lower portions of first front throttle body 53*a* and the upper and lower portions of first rear throttle body 54*a*.

As described above, front throttle bodies 53*a* and 53*b* and rear throttle bodies 54*a* and 54*b* are fixed to each other by right fixing plate 88*a*, left fixing plate 88*b*, and inner connecting member 91. In the plan view, as a connecting member for mutually fixing front throttle bodies 53*a* and 53*b* and rear throttle bodies 54*a* and 54*b*, inner connecting member 91 only is disposed in an area enclosed by center axes A4 and A5 and center axes A6 and A7. In the area enclosed by center axes A4 and A5 and center axes A6 and A7, no connecting members that mutually fix front throttle bodies 53*a* and 53*b* with rear throttle bodies 54*a* and 54*b* are disposed below fuel supply pipe 81.

—Accelerator Position Sensor 51 and Throttle Position Sensor 52—

As shown in FIG. 4, throttle body assembly 50 is provided with accelerator position sensor 51 and a throttle position sensor 52. Throttle position sensor 52 is disposed to the left of second front throttle body 53*b*. Throttle position sensor 52 is connected to valve shaft 65. Throttle position sensor 52 detects a throttle opening angle by detecting rotation of valve shaft 65.

Accelerator position sensor 51 is connected to the right end portion of APS shaft 90, which serves as the second rotational shaft. As FIG. 5 illustrates, a shaft center A3 of APS shaft 90 is located at a position lower than the upper ends of throttle bodies 53 and 54. Note that, when the upper ends of throttle bodies 53 and 54 are different in height, which is not the case in this embodiment, APS shaft 90 is preferably disposed at a position lower than the upper ends of front throttle bodies 53 or than the upper ends of rear throttle bodies 54, whichever is higher.

As shown in FIGS. 4 and 5, in the plan view, motor 60 is disposed in the area enclosed by center axes A4 and A5 of front cylinders 55 and center axes A6 and A7 of rear cylinders 56. Meanwhile, APS shaft 90 is disposed outside the area. Specifically, in relation to the longitudinal direction, APS shaft 90 is disposed such that center axis A3 of APS shaft 90 is located to the front of center axes A4 and A5 of front cylinders 55. More specifically, as shown mainly in FIG. 2, APS shaft 90 is disposed between front head cover 38 and air cleaner 49 in the side view. In this manner, APS shaft 90 is offset with respect to motor 60 in the longitudinal direction.

As shown in FIG. 4, a pulley 92 is attached to APS shaft 90. Throttle wire 18 (FIG. 1) is wound around pulley 92. Therefore, when throttle grip 17 is operated, throttle wire 18 moves, thereby rotating APS shaft 90. Accelerator position sensor 51 detects an accelerator opening angle by detecting rotation of APS shaft 90.

(Control Block of the Motorcycle 1)

A control block of motorcycle 1 is shown in FIG. 10. Electronic control unit (ECU) 80 is provided as a controller and is connected to various types of sensors including accelerator position sensor 51, throttle position sensor 52, a vehicle speed sensor 94 and the like. Accelerator position sensor 51 outputs an accelerator opening angle to ECU 80. Throttle position sensor 52 outputs a throttle opening angle to ECU 80. Vehicle speed sensor 94 outputs a vehicle speed to ECU 80.

ECU 80 is connected to and controls engine 31 based on the input accelerator opening angle, throttle opening angle, vehicle speed, and the like. In addition, ECU 80 is connected to throttle body assembly 50. Specifically, ECU 80 is connected to motor 60 and injectors 75 and 76. ECU 80 drives motor 60 based on the input accelerator opening angle, throttle opening angle, vehicle speed, and the like. As motor 60 is driven, valve shaft 65 and valve shaft 66 rotate accordingly. As a consequence, throttle valves 57 and 58 move, thereby opening and closing front cylinders 55 and rear cylinders 56. As a result, air taken from air cleaner 49 is introduced into cylinders 55 and 56.

At the same time, ECO 80 controls the amount of fuel supplied from injectors 75 and 76 based on the input accelerator opening angle, throttle opening angle, vehicle speed, and the like. Fuel injected from injectors 75 and 76 is mixed with air supplied from air cleaner 49 to create an air-fuel mixture that is supplied to intake ports 42*a* and 42*b* (FIG. 3).

(Operation and Effects)

As is described above, in the embodiment, as shown in FIGS. 4 and 5, motor 60 and APS shaft 90 which serves as the second rotational shaft are offset from each other in the longitudinal direction. Therefore, when compared with a case in which motor 60 and APS shaft 90 are arranged in the vertical direction, the height of throttle body assembly 50 can be suppressed.

Moreover, by disposing motor 60, which normally has a larger volume than accelerator position sensor 51, in the area enclosed by center axes A4 and A5 of front cylinders 55 and center axes A6 and A7 of rear cylinders 56 in a plan view, a longitudinal length of throttle body assembly 50 can be shortened. Therefore, the size of throttle body assembly 50 can be reduced and downsizing of engine unit 30 can be achieved.

Furthermore, since the size of engine unit 30 can be reduced, the capacity of air cleaner 49 which serves as the intake member disposed on throttle body assembly 50 can be increased. Accordingly, intake noise can be reduced.

Moreover, since the longitudinal length of throttle body assembly 50 can be reduced, the V-bank angle $\theta_0$ of engine 31 can also be decreased.

In addition, by reducing the size of engine unit 30, a space for installing battery 47 is increased. Accordingly, battery 47 can be installed even though it is large.

In the embodiment, APS shaft 90 is described as disposed to the front of center axes A4 and A5 of front cylinders 55 in the longitudinal direction. However, APS shaft 90 may be disposed to the rear of center axes A4 and A5 of front cylinders 55 in the longitudinal direction. In this case, size reduction of throttle body assembly 50 is still achieved.

Furthermore, in the embodiment, the second rotational shaft does not need to be APS shaft 90. That is, a rotational shaft other than APS shaft 90 may be arranged offset with respect to motor 60 in the longitudinal direction.

Moreover, in the embodiment, as shown in FIG. 9, motor 60 which serves as an actuator is disposed such that its upper end is located at a position lower than the upper ends of throttle bodies 53 and 54. Therefore, the height dimension of throttle body assembly 50 can be reduced more effectively. As a result, the height dimension of engine unit 30 can be reduced more effectively.

Note that, when the upper end of front throttle body 53 and the upper end of rear throttle body 54 are different in height, the aforementioned effects can be achieved by locating the upper end of motor 60 at a position lower than the upper end of front throttle body 53 or the upper end of rear throttle body 54, whichever is higher.

As shown in FIG. 5, APS shaft 90 which serves as the second rotational shaft is disposed such that center axis A3 of APS shaft 90 is located at a position lower than the upper ends of throttle bodies 53 and 54. Therefore, the height dimension of throttle body assembly 50 can be reduced more effectively. As a result, the height dimension of engine unit 30 can be reduced more effectively.

When the upper ends of throttle bodies 53 and 54 are different in height, the aforementioned effects can be achieved by disposing APS shaft 90 such that its center axis A3 is located at a position lower than the upper end of front throttle body 53 or the upper end of rear throttle body 54, whichever is higher.

Meanwhile, since engine unit 30 is a source of vibration, a clearance of a predetermined distance or more needs to be provided between air cleaner 49 and engine unit 30, as shown in FIG. 2. Specifically, front head cover 38 must be disposed apart from air cleaner 49. In the embodiment, APS shaft 90 and accelerator position sensor 51 are arranged in a space between front head cover 38 and air cleaner 49. Accordingly, by effectively using the space between front head cover 38 and air cleaner 49, the height dimension of throttle body assembly 50 can be reduced, and overall size reductions can be achieved with respect to air cleaner 49, throttle body assembly 50 and engine unit 30.

Furthermore, vehicle width and height are severely restricted for a straddle-type vehicle, particularly a motorcycle. Therefore, the installation space for throttle body assembly 50 and engine unit 30 is severely restricted. In particular, in a motorcycle which has throttle body assembly 50 disposed between left and right frame portions 11*a* and 11*b* in the plan view, the installation space for throttle body assembly 50 and engine unit 30 is even more severely restricted. As a consequence, the present invention, which allows size reduction of throttle body assembly 50, is effective for straddle-type vehicles, particularly for motorcycles.

In the embodiment, in a plan view, motor 60 is disposed in the area enclosed by center axes A4 and A5 of front cylinders 55 and center axes A6 and A7 of rear cylinders 56. APS shaft 90, which serves as the second rotational shaft, is located outside the area. Positional interference between APS shaft 90 and motor 60 is thereby reliably suppressed. As a result, the degree of freedom in the arrangement of motor 60 and accelerator position sensor 51 attached to APS shaft 90 is increased. Accordingly, the degree of freedom in design of throttle body assembly 50 is increased.

Furthermore, by disposing APS shaft 90 and accelerator position sensor 51 to the front of center axes A4 and A5 of front cylinders 55 or to the rear of center axes A6 and A7 of rear cylinders 56, throttle bodies 53*a*, 53*b*, 54*a* and 54*b* can be arranged relatively close to each other. As a result, the V-bank angle of engine 31 can also be reduced.

Specifically, in the embodiment, APS shaft 90 is disposed to the front of center axes A4 and A5 of front cylinders 55 in the longitudinal direction. Therefore, throttle grip 17 and APS shaft 90 can be connected easily. Specifically, the length of winding of throttle wire 18 can be reduced and positional interference of throttle wire 18, front cylinders 55 and the like can be avoided. Therefore, the winding of throttle wire 18 becomes easy.

In the embodiment, as shown in FIGS. 3 and 6, the upper end portions of injectors 75 and 76 are connected with fuel supply pipe 81. Therefore, positional interference between injectors 75 and 76 and fuel supply pipe 81 does not occur and an angle formed by injectors 75 and 76 can be decreased. As a result, throttle bodies 53 and 54 can be arranged close to each other in the longitudinal direction. Therefore, the V-bank angle $\theta_0$ of engine 31 can be made smaller.

Particularly, in the embodiment, fuel supply pipe 81 is shared by front injector 75 and rear injector 76. Therefore, compared with a case in which a fuel supply pipe is separately provided for each of injectors 75 and 76, the size of throttle body assembly 50 can be reduced. For instance, compared with a case in which two fuel supply pipes are arranged in the longitudinal direction, a distance between front and rear throttle bodies 53 and 54 can be reduced. As a result, the V-bank angle $\theta_0$ of engine 31 can be made smaller. Also, for example, compared to a case in which two fuel supply pipes are arranged in the vertical direction, the height dimension of throttle body assembly 50 can be reduced.

Moreover, in the embodiment, fuel supply pipe 81 is disposed at a position lower than the upper ends of throttle bodies 53 and 54. Therefore, in relation to the vertical direction, injectors 75 and 76 can be accommodated between the upper ends and lower ends of throttle bodies 53 and 54. Accordingly, the overall height of throttle body assembly 50 can be reduced.

In the embodiment, connectors 77 and 78 are arranged in such a manner as to extend obliquely with respect to the longitudinal direction. Accordingly, positional interference between connectors 77 and 78 is suppressed. As a result, an angle between injectors 75 and 76 can be reduced. Consequently, throttle bodies 53 and 54 can be arranged close to each other in the longitudinal direction. As a consequence, the V-bank angle $\theta_0$ of engine 31 can be made smaller.

In the embodiment motor 60 is offset with respect to fuel supply pipe 81 in the longitudinal direction. Specifically, a location of shaft center A1 of rotational shaft 60*a* at which the height dimension of motor 60 is at its highest is offset in the longitudinal direction with respect to center axis A2 of fuel supply pipe 81. Accordingly, motor 60 and fuel supply pipe 81 can be arranged close to each other in the height direction. Therefore, the height dimension of throttle body assembly 50 can be reduced. That is, motor 60 is disposed between front throttle body 53 and rear throttle body 54 in the longitudinal direction, and motor 60 and fuel supply pipe 81 are offset from each other in the longitudinal direction. By this structure, both the longitudinal and height dimensions of throttle body assembly 50 can be reduced. As a result, both the longitudinal and height dimensions of engine unit 30 can be reduced.

MODIFIED EXAMPLE

Figure 11:
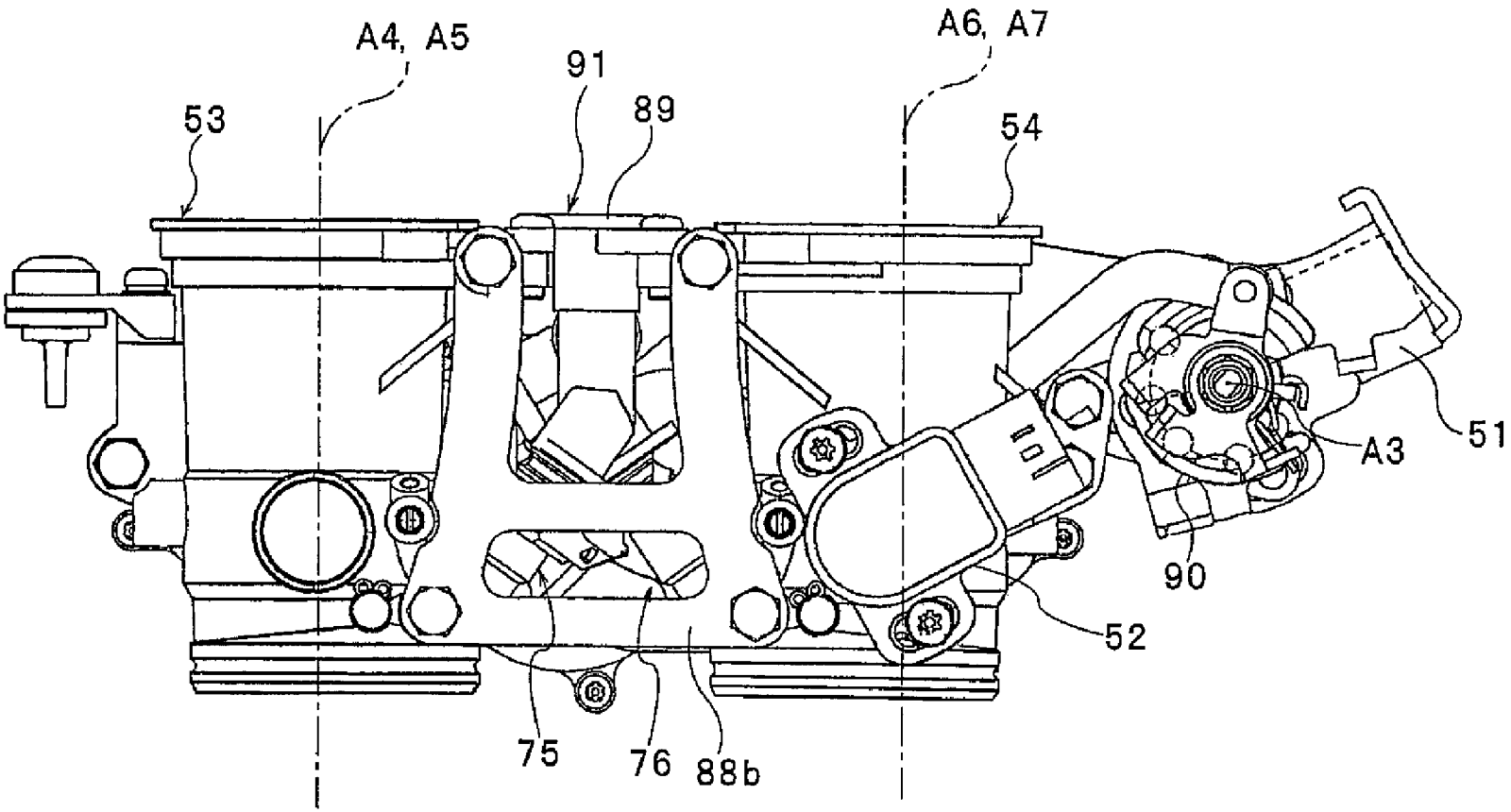
FIG. 11 is a left side view of a throttle body assembly according to a modified embodiment of the invention.
Figure 12:
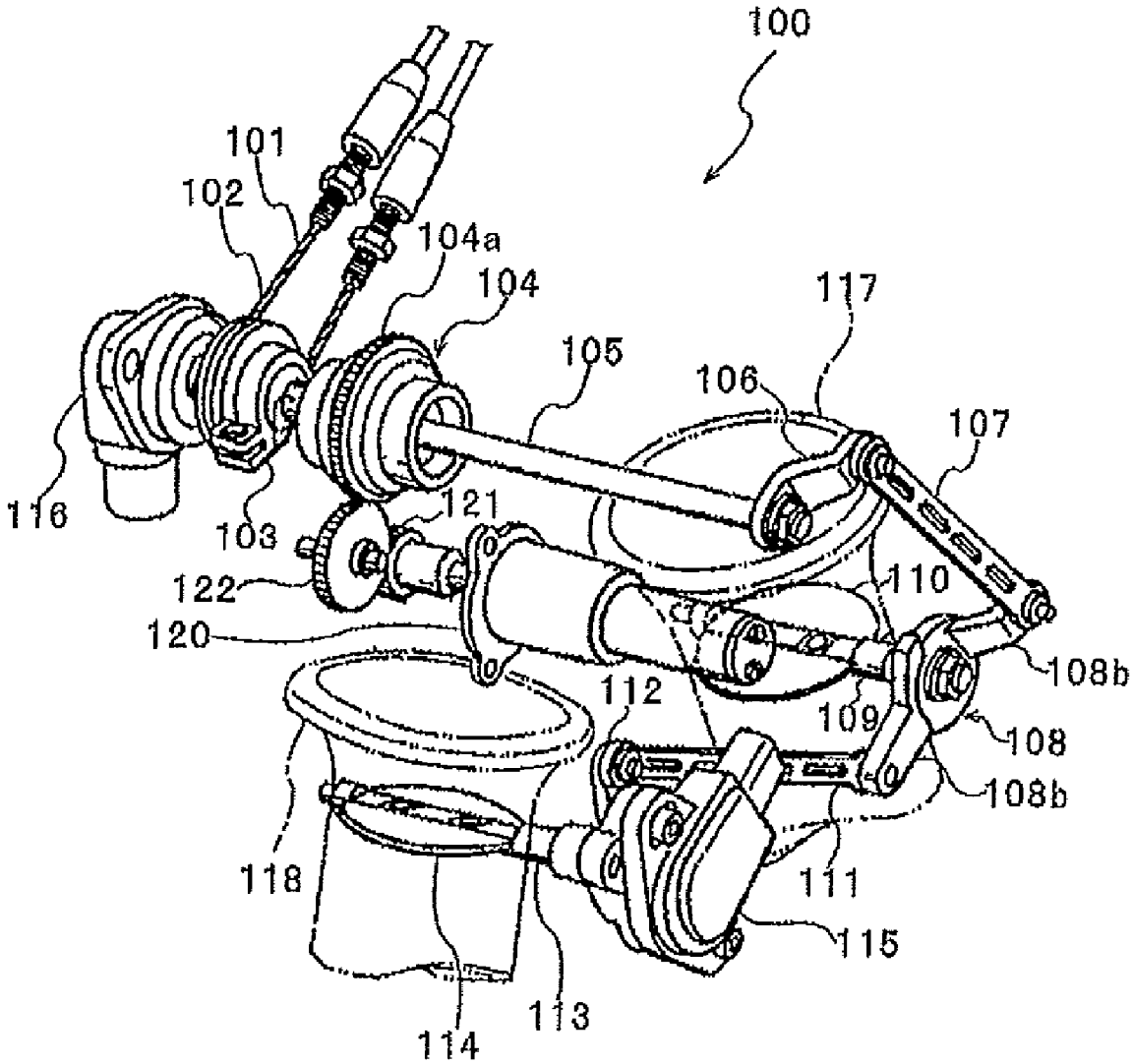
FIG. 12 PRIOR ART
FIG. 12 is a perspective view of a throttle body assembly of the related art.

In the aforementioned embodiment, shaft center A3 of APS shaft 90 is described as located to the front of center axes A4 and A5 of front cylinders 55*a* and 55*b*. However, the invention is not restricted to this structure. For example, as shown in FIG. 11, shaft center A3 of APS shaft 90 may be located to the rear of center axes A6 and A7 of rear cylinders 56*a* and 56*b*.

Furthermore, in the embodiment, APS shaft 90 is described as offset with respect to rotational shaft 60*a* of motor 60. That is, the case in which the second rotational shaft is shaft 90 has been explained. However, in the invention, the second rotational shaft is not restricted to APS shaft 90.

The invention claimed is:

1. An engine unit including a V-type engine provided with a front cylinder, a rear cylinder, a front intake port connected to the front cylinder, and a rear intake port connected to the rear cylinder, and a throttle body assembly attached to the V-type engine, the throttle body assembly comprising:

a front throttle body that is provided with a front cylinder connected to the front intake port and has a front throttle valve for opening and closing the front cylinder;

a rear throttle body that is provided with a rear cylinder connected to the rear intake port and has a rear throttle valve for opening and closing the rear cylinder;

an actuator that has a first rotational shaft that extends in a widthwise direction, disposed between a center axis of the front cylinder and a center axis of the rear cylinder, and drives the front throttle valve and the rear throttle valve; and a second rotational shaft having a shaft center that is located to one of the front of and to the rear of a shaft center of the first rotational shaft.

2. The engine unit according to claim 1, wherein the throttle body assembly further comprises an accelerator position sensor that is attached to the second rotational shaft and detects a throttle operation amount.

3. The engine unit according to claim 1, wherein the shaft center of the second rotational shaft is located to the rear the center axis of the rear cylinder of the rear throttle body.

4. The engine unit according to claim 1, wherein the shaft center of the second rotational shaft is located to the front of the center axis of the front cylinder of the front throttle body.

5. The engine unit according to claim 1, wherein an upper end of the actuator is located at a position lower than one of an upper end of the front throttle body and an upper end of the rear throttle body, whichever is higher.

6. The engine unit according to claim 1, wherein the shaft axis of the second rotational shaft is located at a position lower than one of an upper end of the front throttle body and an upper end of the rear throttle body, whichever is higher.

7. The engine unit according to claim 1, wherein the throttle body assembly further comprises:

a fuel supply pipe that extends in the widthwise direction and is disposed at a position between the center axis of the front cylinder of the front throttle body and the center axis of the rear cylinder of the rear throttle body in a longitudinal direction, and lower than one of an upper end of the front throttle body and an upper end of the rear throttle body, whichever is higher;

a front injector that is attached to the front throttle body and connected to the fuel supply pipe at an upper end portion of the front injector; and a rear injector that is attached to the rear throttle body and connected to the fuel supply pipe at an upper end portion of the rear injector.

8. The engine unit according to claim 7, wherein the V-type engine includes a control portion that controls an amount of fuel supply based on the throttle operation amount, the front and rear injectors each has a connector connected to the control portion, the connectors extend obliquely with respect to the longitudinal direction.

9. The engine unit according to claim 1, wherein the second rotational shaft is not disposed between the center axis of the front cylinder of the front throttle body and the center axis of the rear cylinder of the rear throttle body.

10. The engine unit according to claim 1, wherein the shaft center of the first rotational shaft is offset from the shaft center of the second rotational shaft in a longitudinal direction of the engine unit.

11. The engine unit according to claim 1, wherein the throttle body assembly further comprises:

a fuel supply pipe that extends in the widthwise direction and is disposed at a position between the center axis of the front cylinder of the front throttle body and the center axis of the rear cylinder of the rear throttle body in a longitudinal direction, and lower than an upper end of the front throttle body and an upper end of the rear throttle body, whichever is higher;

a front injector that is connected to the fuel supply pipe at an upper end portion of the front injector, and injects fuel supplied from the fuel supply pipe into the front cylinder of the front throttle body; and a rear injector that is connected to the fuel supply pipe at an upper end portion of the rear injector, and injects fuel supplied from the fuel supply pipe into the rear cylinder of the rear throttle body, and a shaft center of the first rotational shaft is located to one of the front of and to the rear of the center axis of the fuel supply pipe in relation to the longitudinal direction.

12. A vehicle including an engine unit including a V-type engine provided with a front cylinder, a rear cylinder, a front intake port connected to the front cylinder, and a rear intake port connected to the rear cylinder, and a throttle body assembly attached to the V-type engine, the throttle body assembly comprising:

a front throttle body that is provided with a front cylinder connected to the front intake port and has a front throttle valve for opening and closing the front cylinder;

a rear throttle body that is provided with a rear cylinder connected to the rear intake port and has a rear throttle valve for opening and closing the rear cylinder;

an actuator that has a first rotational shaft that extends in a widthwise direction, disposed between a center axis of the front cylinder and a center axis of the rear cylinder, and drives the front throttle valve and the rear throttle valve; and a second rotational shaft having a shaft center that is located to one of the front of and to the rear of a shaft center of the first rotational shaft.

13. The vehicle according to claim 12, further comprising:

an intake system part that is located on the front and rear throttle bodies and connected with the front and rear cylinders of the throttle bodies.

14. The vehicle according to claim 13, further comprising:

an accelerator position sensor included in the throttle body assembly and that is attached to the second rotational shaft and detects a throttle operation amount; and a head cover included in the V-type engine and that is disposed above the front cylinder and such that at least a part of the head cover is located under the intake system part, and the accelerator position sensor is disposed to the front of the center axis of the front cylinder and between the intake system part and the head cover.

15. The vehicle according to claim 12, wherein the vehicle is a Motorcycle.

16. The vehicle according to claim 15, further comprising:

a head pipe; and left and right frames that extend to the rear from the head pipe, wherein the throttle body assembly is disposed between the left and right frames in a plan view.

17. The vehicle according to claim 12, wherein the second rotational shaft is not disposed between the center axis of the front cylinder of the front throttle body and the center axis of the rear cylinder of the rear throttle body.

18. New The vehicle according to claim 12, wherein the shaft center of the first rotational shaft is offset from the shaft center of the second rotational shaft in a longitudinal direction of the engine unit.

19. The vehicle according to claim 12, wherein the second rotational shaft is towards one of a front of the engine relative to the shaft center of the first rotational shaft and a rear of the engine relative to the shaft center of the first rotational shaft.

20. An engine unit including a V-type engine provided with a front cylinder, a rear cylinder, a front intake port connected to the front cylinder, and a rear intake port connected to the rear cylinder, and a throttle body assembly attached to the V-type engine, the throttle body assembly comprising:

a front throttle body that is provided with a front cylinder connected to the front intake port and has a front throttle valve for opening and closing the front cylinder of the front throttle body;

a rear throttle body that is provided with a rear cylinder connected to the rear intake port and has a rear throttle valve for opening and closing the rear cylinder of the rear throttle body;

an actuator that has a first rotational shaft that extends in a widthwise direction, disposed between a center axis of the front cylinder of the front throttle body and a center axis of the rear cylinder of the rear throttle body, and drives the front throttle valve and the rear throttle valve; and a second rotational shaft having a shaft center that is located towards one of a front of a shaft center of the first rotational shaft and to a rear of the shaft center of the first rotational shaft, relative to a lengthwise direction that is perpendicular to the widthwise direction.

* * * * *